US010674816B1

(12) United States Patent
Shih

(10) Patent No.: US 10,674,816 B1
(45) Date of Patent: Jun. 9, 2020

(54) STORAGE CABINET STRUCTURE

(71) Applicant: MAIN GOOD FURNITURE CO., LTD., Lu-Kang Chen, Changhua Hsien (TW)

(72) Inventor: Shu-Fen Shih, Changhua Hsien (TW)

(73) Assignee: MAIN GOOD FURNITURE CO., LTD., Changhua Hsien (TW)

( * ) Notice: Subject to any disclaimer, the term of this patent is extended or adjusted under 35 U.S.C. 154(b) by 0 days.

(21) Appl. No.: 16/453,437

(22) Filed: Jun. 26, 2019

(51) Int. Cl.
*A47B 47/00* (2006.01)
*A47B 96/06* (2006.01)
*A47B 96/04* (2006.01)

(52) U.S. Cl.
CPC ..... *A47B 47/00* (2013.01); *A47B 96/04* (2013.01); *A47B 96/068* (2013.01)

(58) Field of Classification Search
CPC . A47B 47/00; A47B 47/0058; A47B 47/0091; A47B 47/02; A47B 47/021; A47B 47/024; A47B 47/027; A47B 47/03; A47B 47/04; A47B 47/047; A47B 47/05; A47B 55/00; A47B 91/00; A47B 91/005; A47B 96/04; A47B 2220/0027
See application file for complete search history.

(56) References Cited

U.S. PATENT DOCUMENTS 3,572,872 A * 3/1971 Fenwick ..... A47B 13/06 312/263
4,665,838 A * 5/1987 Minshall ..... A47B 47/021 108/157.13
4,793,667 A * 12/1988 Gilliom ..... A47B 47/03 312/108
6,786,009 B1 * 9/2004 McGunn ..... A47B 47/03 312/263
10,506,876 B1 * 12/2019 Chen ..... A47B 47/047
2010/0079045 A1 * 4/2010 Yeh ..... A47B 47/04 312/263
2019/0072122 A1 * 3/2019 DeSmet ..... F16B 19/004

FOREIGN PATENT DOCUMENTS

FR 1357057 A * 4/1964 ..... A47B 47/0083
GB 631374 A * 11/1949 ..... A47B 47/04

* cited by examiner

*Primary Examiner* — Andrew M Roersma

(57) ABSTRACT

A storage cabinet structure has a front frame, a supporting set, a rear frame, a bottom board and a top board. The semi-composed state of the front frame and the rear frame can save a large amount of assembly time for the user, and the first bolt, the second bolt and the third bolt allow the user to lock the front frame, the supporting set, the rear frame and the top board to achieve DIY assembly without any tools and have the advantages of simplifying assembly steps and being easy to assemble by one person. The direct placement of the bottom board is fixed with the sliding of the divider, and then the fixing of the top board forms a barrier to the bottom board and the divider, thereby effectively saving assembly time and reducing the number of parts, and has the practical function of tool-free, simplified assembly steps and quick assembly by one person.

9 Claims, 10 Drawing Sheets

STORAGE CABINET STRUCTURE

BACKGROUND OF INVENTION

Field of Invention

The present invention relates to a storage cabinet structure, and more particularly to a storage cabin structure requiring no assembly tool.

Description of the Related Art

According to the conventional storage locker and storage frame structures, the utility model is mainly composed of a plurality of frame rods, a plurality of plate bodies and a plurality of screws, and the assembly can be started by random plates, frames or rods. Therefore, it is difficult for the user to know where the component is installed and requires the explanatory assembly chart which may causes assembly errors or incomplete assembly. Furthermore, during assembling, a hand tool (such as a screwdriver) is required to lock the screws into the aligned screw holes of different parts, which can be inconvenience to the user self-assembly. In addition, the screw hole of different parts are also not easy to be aligned, so it is possible to cause the screw hole being reamed which affects the stability of the entire structure.

Therefore, it is desirable to provide a storage cabinet structure requiring no assembly tool to mitigate and/or obviate the aforementioned problems.

SUMMARY OF THE INVENTION

An objective of present invention is to provide a storage cabinet structure requiring no assembly tool, which is capable of improving the above-mention problems.

In order to achieve the above mentioned objective, a storage cabinet structure has: a front frame, a supporting set, a rear frame, a bottom board and a top board 50. The front frame has a front top rod, a front bottom rod and two front side rods, the front top rod having a plurality of through apertures, the front bottom rod having a plurality of screw holes, each front side rod pivoted with a side board. The supporting set has a plurality of leg members and at least one horizontal rod, opposite ends of each leg member and each horizontal rod having at least one through hole, each through hole provided with a first bolt configured to engage with the screw holes of the front bottom rod. The rear frame has a rectangular shape with a rear top rod, a rear bottom rod and two rear side rods, the rear top rod having a plurality of through apertures, the rear bottom rod has a plurality of screw holes configured to engage with the first bolts, each rear side rod having a plurality of connecting plates, each connecting plate has a second bolt, one end of the side board capable of being locked onto the connecting plates of the rear side rods via the second bolts. The bottom board is disposed among the front frame, the side board and the rear frame, the bottom board are mounted onto the supporting set. The top board has a plurality of securing apertures on edges thereof, each securing aperture provided with a plug, the top board covering the front top rod and the rear top rod, the plugs inserted into the through apertures of both the front top rod and the rear top rod.

Other objects, advantages, and novel features of invention will become more apparent from the following detailed description when taken in conjunction with the accompanying drawings.

DETAILED DESCRIPTION OF THE PREFERRED EMBODIMENT

Figure 1:
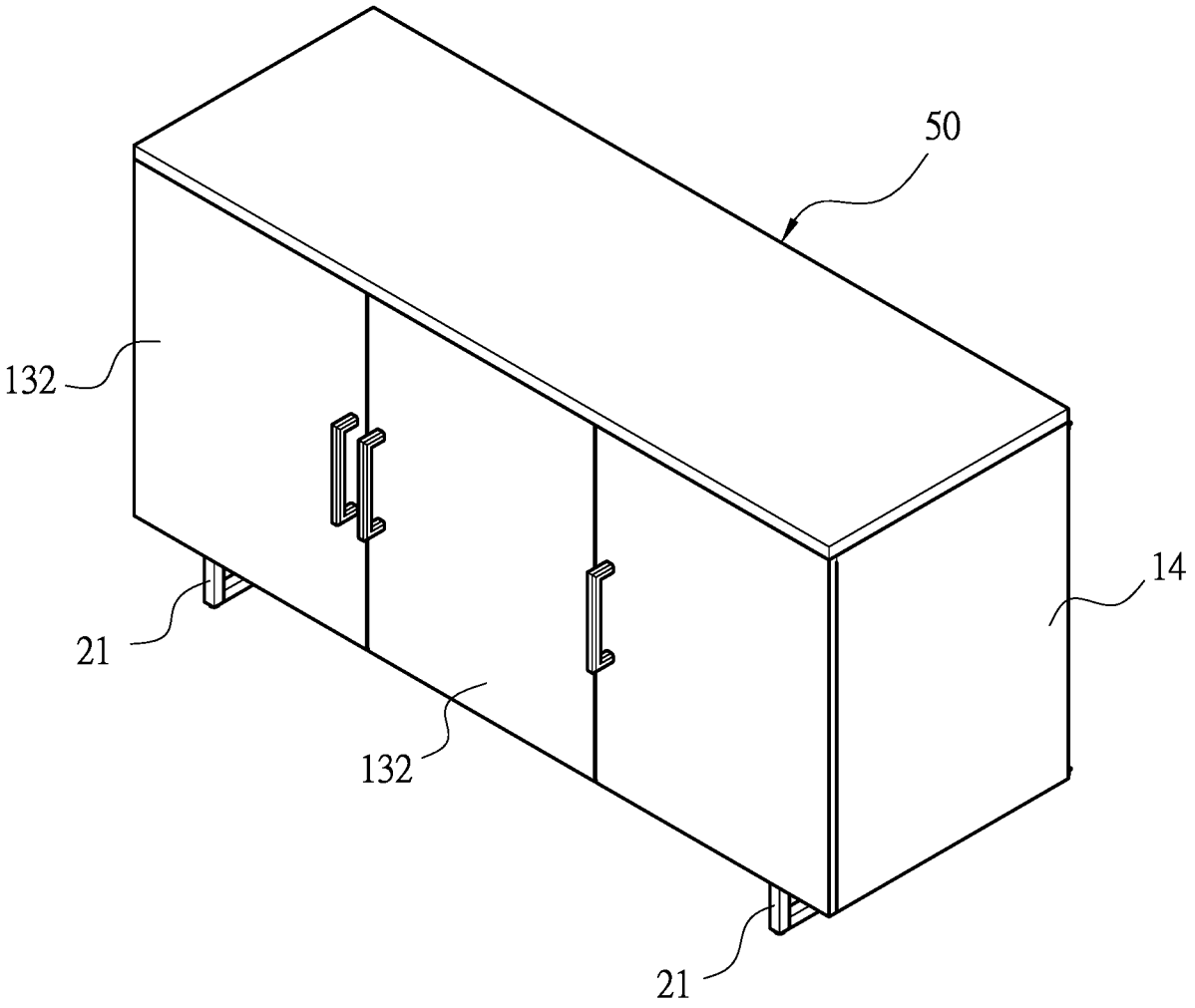
FIG. 1 is a perspective view of the present invention.
Figure 2:
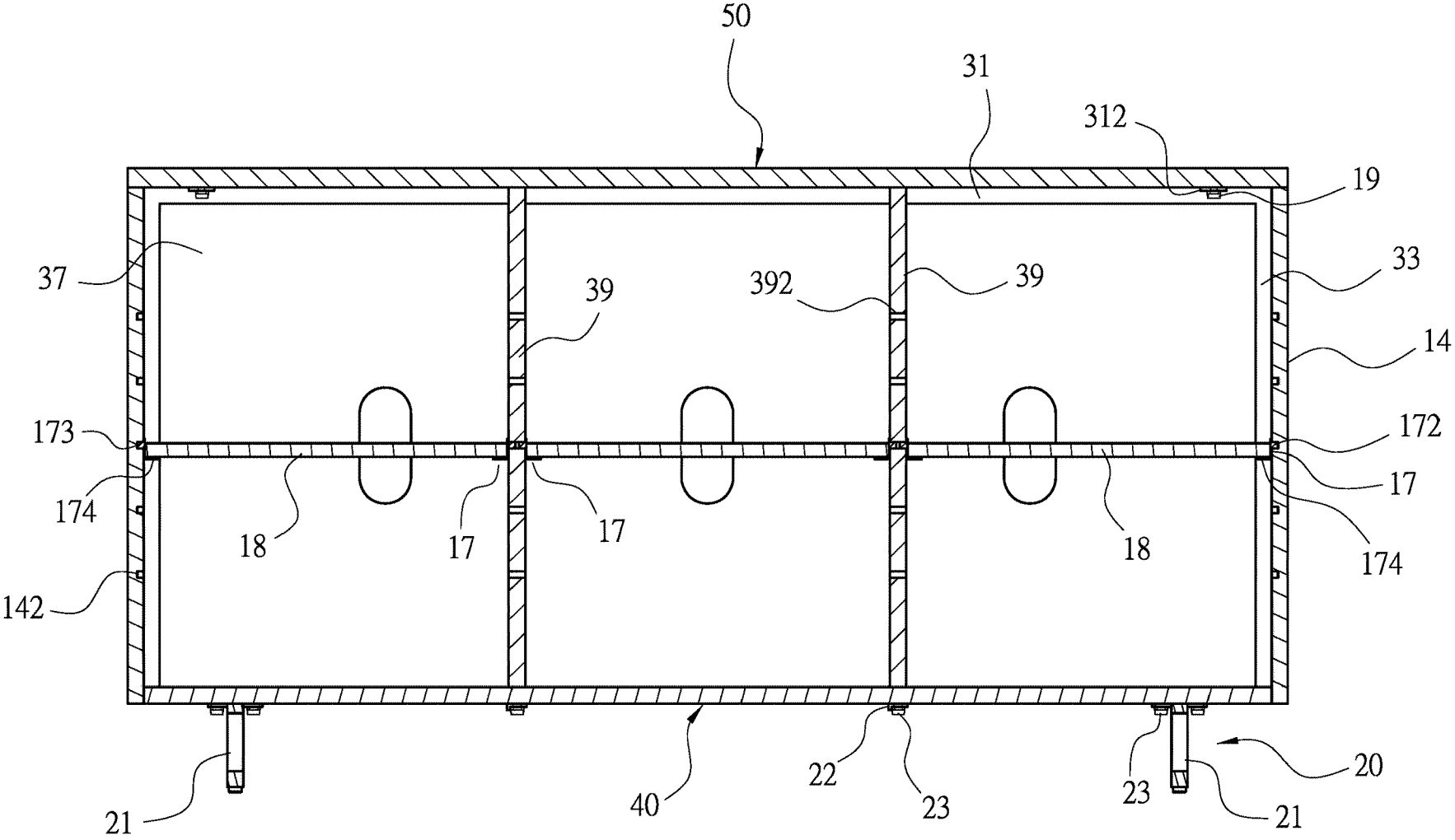
FIG. 2 is a transverse cross-sectional view of the present invention.
Figure 3A:
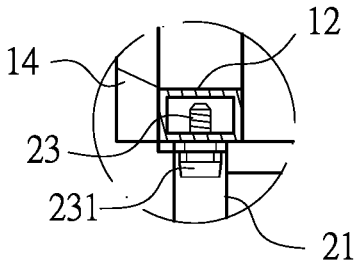
FIG. 3A is a partial cross-sectional view of the front bottom rod being coupled to the leg member according to of the present invention.
Figure 3B:
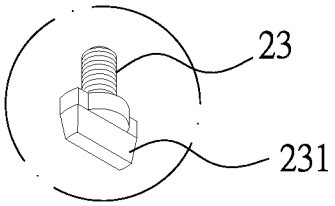
FIG. 3B is a perspective view of the first bolt according to the present invention.
Figures 4, 4A:
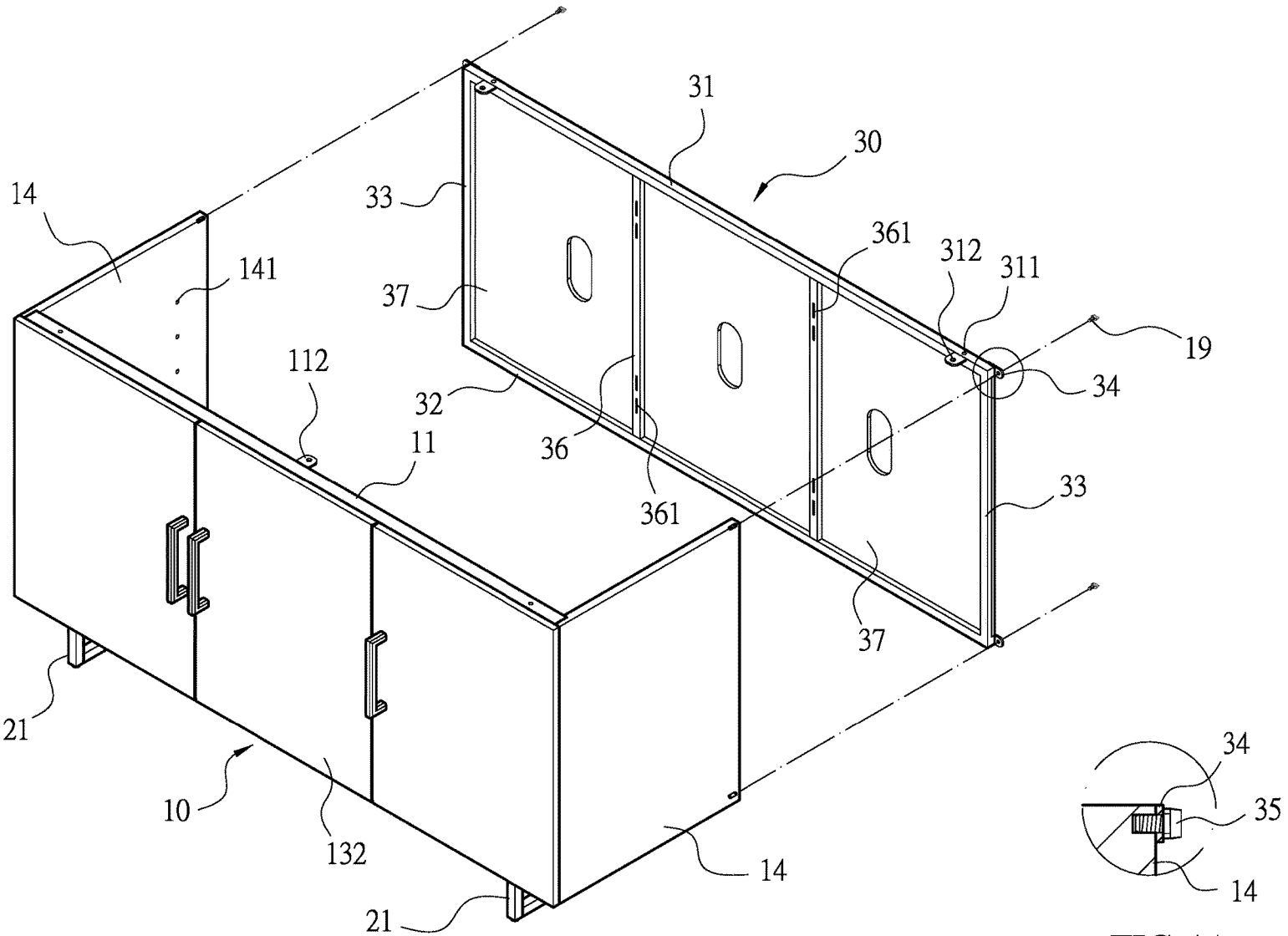
FIG. 4 is another assembly steps diagram of the present invention.
FIG. 4A is a partial cross-sectional view of the side board being coupled with the rear side rod according to the present invention.
Figure 5:
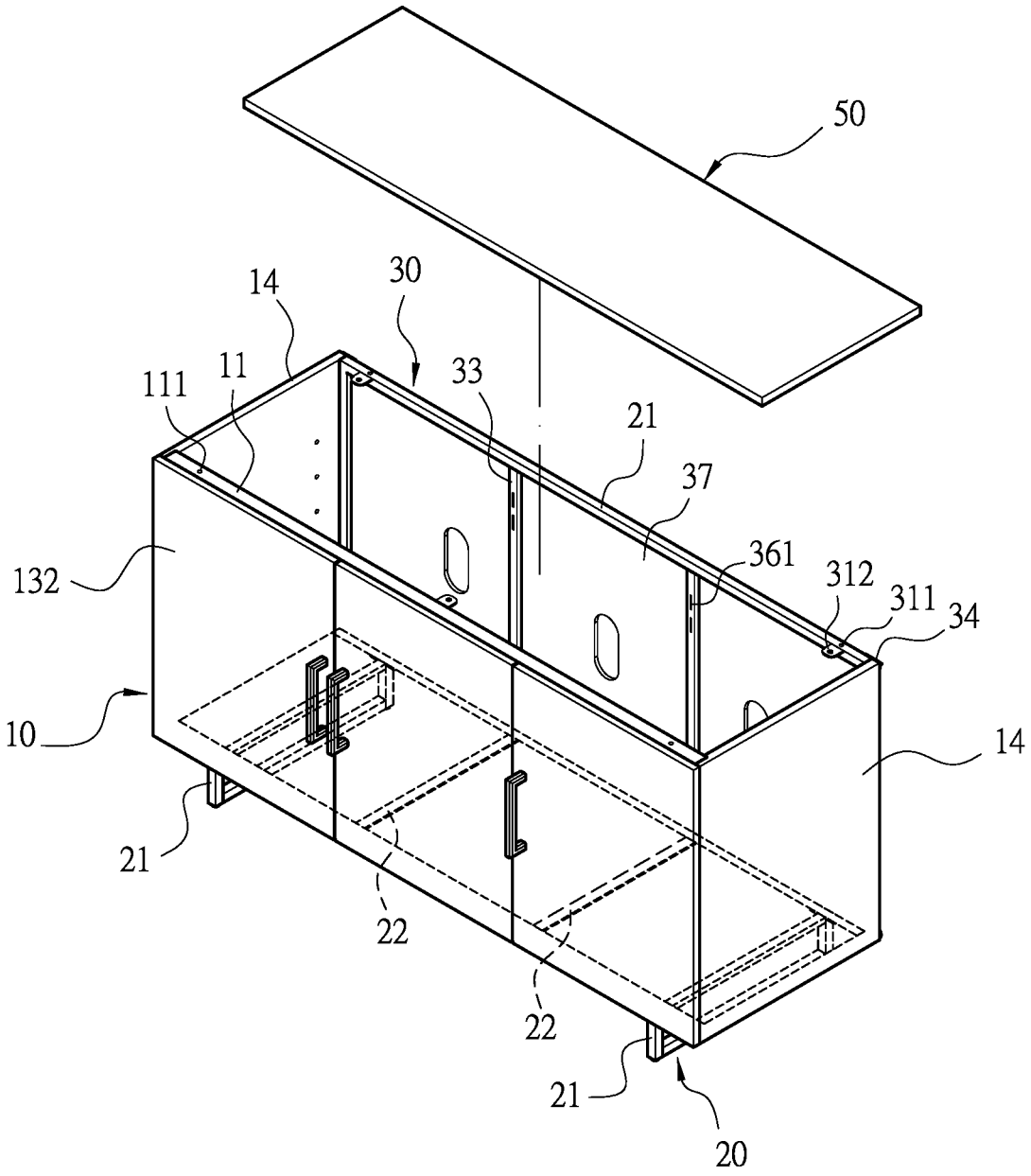
FIG. 5 is another assembly steps diagram of the present invention.
Figure 6:
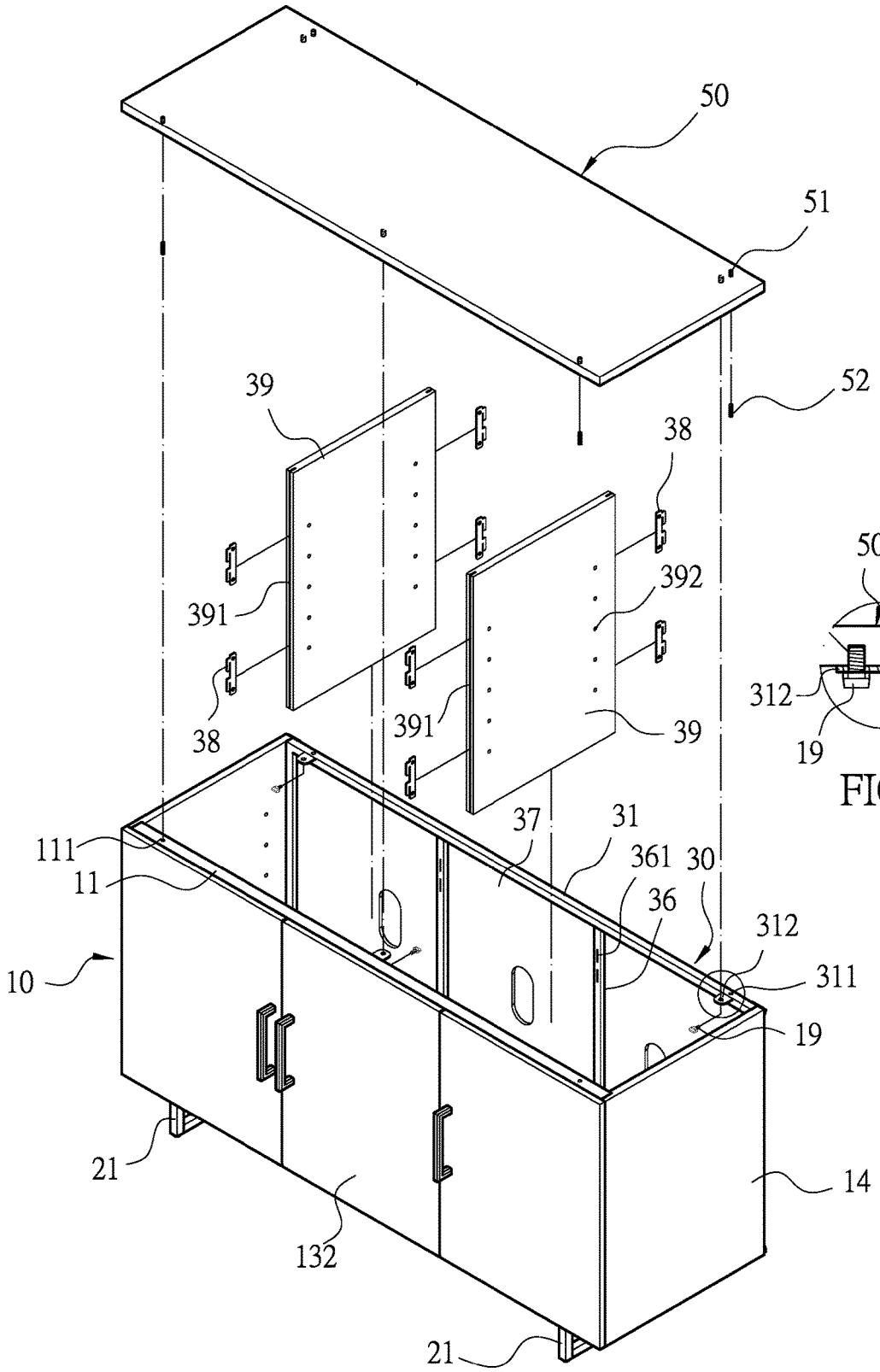
FIG. 6 is another assembly steps diagram of the present invention.
Figure 6A:
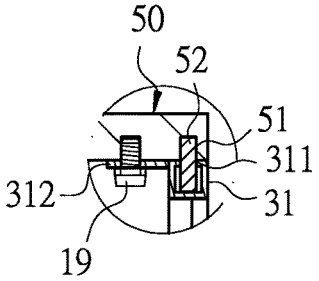
FIG. 6A is a partial cross-sectional view of the top board being coupled to the rear top rod according to the present invention.
Figure 7:
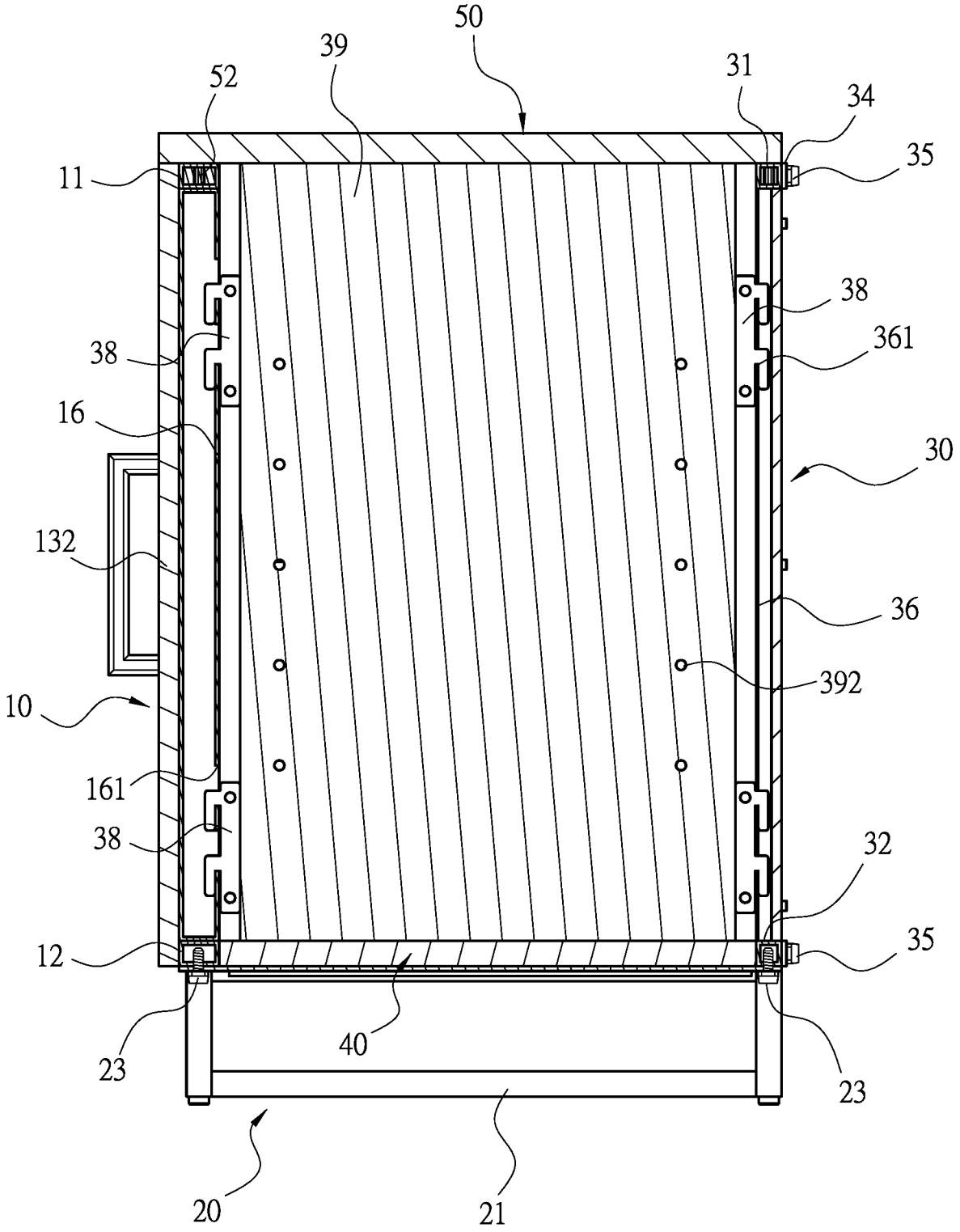
FIG. 7 is a longitudinal cross-sectional view of the present invention.
Figures 8, 8A:
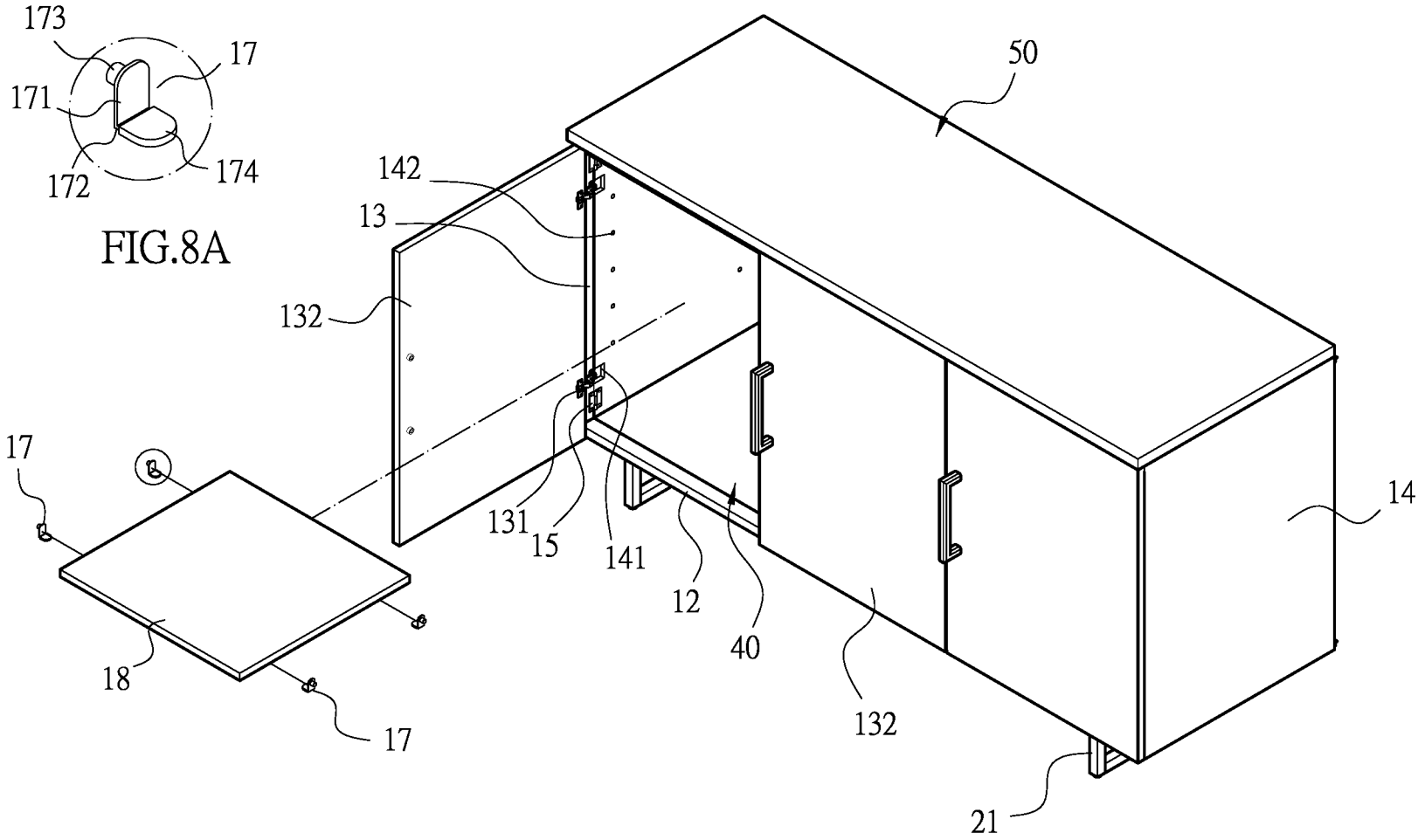
FIG. 8 is another assembly steps diagram of the present invention.
FIG. 8A is a perspective view of the first bolt according to the present invention.
Figure 9A:
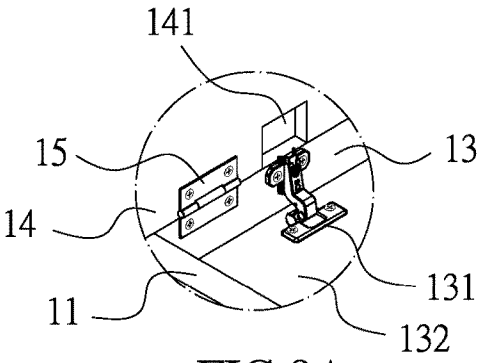
FIG. 9A is a schematic drawing of a connected junction of the front side rod and the side board according to the present invention.
Figure 9:
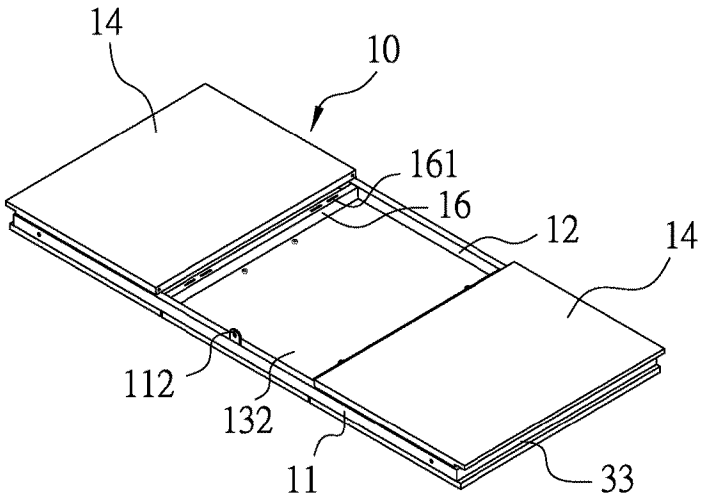
FIG. 9 is a perspective view of the present invention in a folded state.
Figure 9:
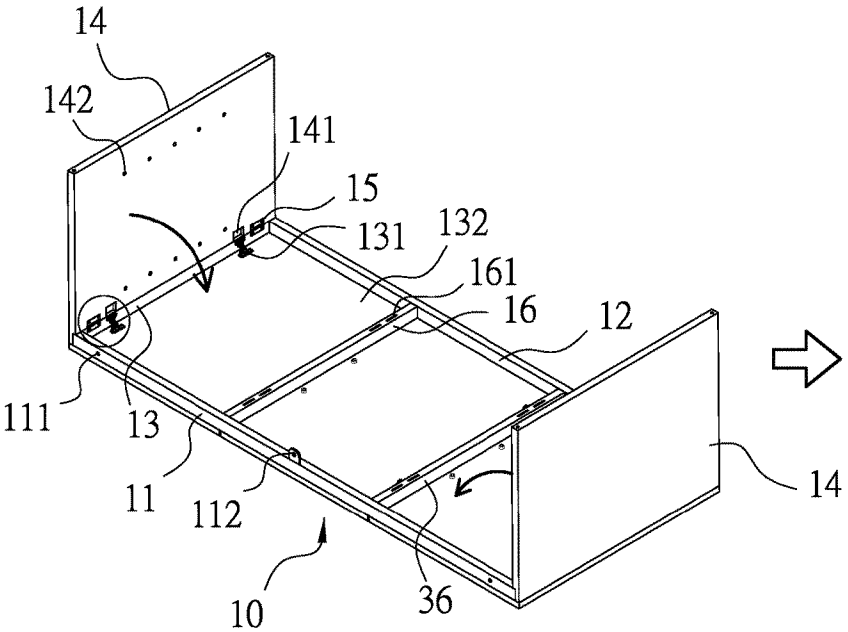

Please refer to FIGS. 1-5 with FIG. 9. A storage cabinet structure comprises: a front frame 10, a supporting set 20, a rear frame 30, a bottom board 40 and a top board 50. The front frame 10 has a front top rod 11, a front bottom rod 12 and two front side rods 13. The front top rod 11 has a plurality of through apertures 111, the front bottom rod has a plurality of screw holes 121, and each front side rod 13 is pivoted with a side board 14. The front frame 10 further comprises at least one front standing rod 16 between the front top rod 11 and the front bottom rod 12, and a plurality of door shaft sets 131 are disposed on the front standing rod 16 and the front side rod 13 and configured to attach to at least one door member 132. A door hinge set 15 is installed for a pivoting connection between the front side rod 13 and the side board 14, and the side board 14 further has an indentation 141 corresponding to the door hinge 15. Therefore, the side board 14 is capable of swing around the door hinge 15. The supporting set 20 has a plurality of leg members 21 and at least one horizontal rod 22, opposite ends of each leg member 21 and each horizontal rod 22 have at least one through holes 211, 221, and each through hole 211, 221 are provided with a first bolt 23 configured to engage with the screw holes 121 of the front bottom rod 12 (as shown in FIG. 3A). The rear frame 30 has a rectangular shape with a rear top rod 31, a rear bottom rod 32 and two rear side rods 33. The rear top rod 31 has a plurality of through apertures 311, the rear bottom rod 32 has a plurality of screw holes 321 configured to engage with the first bolts 23, and each rear side rod 33 has a plurality of connecting plates 34. Each connecting plate 34 has a second bolt 35, one end of the side board 34 is capable of being locked onto the connecting plate 34 of the rear side rods 33 via the second bolts 35 as shown in FIG. 4A). The rear frame 30 further comprises at least one rear standing rod 36 disposed between the rear top rod 31 and the rear bottom rod 32, and the rear frame 30 and the rear standing rod 36 are covered and secured with a rear board 37. The bottom board 40 is disposed among the front frame 10, the side board 14 and the rear frame 30 and above the supporting set 20. As shown in FIGS. 6, 7 and 8, both of the front standing rod 16 and the rear standing rod 36 have at least one engaging groove 161, 361, and each engaging groove 161, 361 is mounted with a positioning sheet 38. Furthermore, a divider 39 is connected between the front standing rod 16 and the rear standing rod 36, and the divider 39 further respectively has a slot 391 facing the front standing rod 16 and the rear standing rod 36 and engaging with the positioning sheet 38 of the front standing rod 16 and the rear standing rod 36. A plurality of assembling apertures 142, 392 are correspondingly disposed on the side board 14 and the divider 39, and a supporting member 17 is inserted in the assembling aperture 142, 392 and horizontally disposed between the side board 14 and the divider 39 to be configured to support at least one storing board 18. As shown in FIG. 8A, the supporting member 17 has a side part 171 and a bottom part 172, the side part 171 has a protrusion 173 inserted into the assembling aperture 142, 392 such that the side part 171 overlaps the side board 14 or the divider 39, and the bottom part 172 is jacketed with an elastic sleeve 174 for supporting the storing board 18. The top board 50 has a plurality of securing apertures 51 on edges thereof, and each securing aperture 51 is provided with a plug 52. The top board 50 covers the front top rod 11 and the rear top rod 31, and the plugs 52 is inserted into the through apertures 111, 311 of both the front top rod 11 and the rear top rod 31. The front top rod 11 and the rear top rod 31 both have a plurality of connecting tabs 112, 312, each connecting tab 112, 312 has a third bolt 19, and each third bolt 19 is locked with the top board 50 (as shown in FIG. 6A). The first bolt 23, the second bolt 35, and the third bolt 19 all respectively have a flat head portion 231 (as shown in FIG. 3B) at an opposite end having a threaded section.

Figure 3:
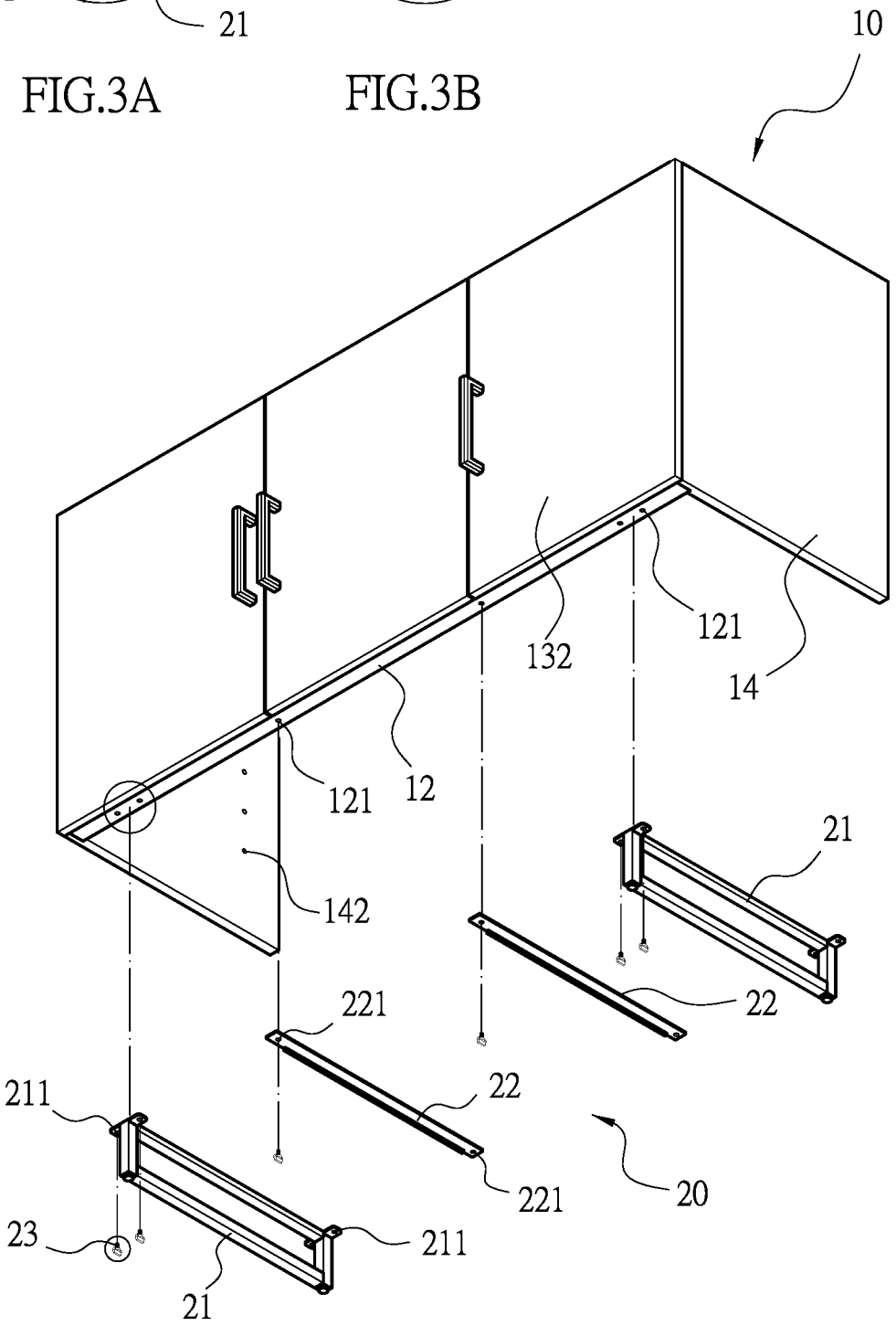
FIG. 3 is an assembly steps diagram of the present invention.

The present invention has the effect of simplifying the assembly steps and facilitating the assembly by a single person. The assembly steps are shown in FIGS. 3, 3A, and 3B. The through holes 211, 221 at one end of the leg members 21 and the horizontal rod 22 are aligned with the screw hole 121 of the front bottom rod 12 of the front frame 10, and the side board 14 is opened by the door hinge 15 and vertically relatively to the front frame 10. The door member 132 of the front frame 10 is already pivotally attached to the front frame 10 by the door shaft set 131 before assembly, the side board 14 is also already assembled onto the front frame 10 via the door hinge 15, which are packaged by overlapping folds to save user's assembly time without affecting inventory and shipping. The next step is shown in FIGS. 4 and 4A. The rear frame 30 is disposed against the leg member 21 and the horizontal rod 22 such that the connecting plate 34 of the rear side rod 33 can reach the side board 14, and the connecting plate 34 is locked with the side board 14 by the second bolt 35. At the same time, the through holes 211, 221 at the other end of the leg member 21 and the horizontal rod 22 can be easily locked to the screw hole 321 of the rear bottom rod 32. Thereby, the front frame 10 and the rear frame 30 can be formed into a rectangular shape frame. Next step is as shown in FIG. 5, the bottom board 40 is directly placed into the enclosed space formed by the front frame 10 and the rear frame 30 and laid flat on the leg member 21 and the horizontal rod 22, thereby completing the assembly of the bottom board 40. As shown in FIGS. 6, 6A and 7, the positioning sheet 38 is attached to the engaging grooves 161, 361 of the front standing rod 16 and the rear standing rod 36, and the two slots 391 of the divider 39 engage with the positioning sheet 38 to allow the bottom board 40 to be assembled between the front standing rod 16 and the rear standing rod 36. Then, the top board 50 is overlapped onto the front top rod 11 and the rear top rod 31, such that that the plug 52 provided at the securing aperture 51 of the top board 50 can be inserted into the corresponding through apertures 111, 311, and further the third bolt 19 passes through the connecting tabs 112 to be locked onto the top board 50. The top board 50 can be used to press down the divider 39 and the bottom board 40, thereby effectively saving assembly time and reducing the number of accessories. The final steps are as shown in FIGS. 8, 8A, the supporting member 17 is inserted into the assembling apertures 142, 392 between the side board 14 and the divider 39 via the protrusions 173 according to the user's storage requirements, so that the supporting member 17 can be placed horizontally on the storage board 18 with the elastic sleeve 174.

With the structure of the above embodiment, the following benefits can be obtained: the pre-assembled the front frame 10 and the rear frame 30 can save assembly time, and the first bolt 23, the second bolt 35 and the third bolt 19 allow the user to lock the front frame 10, the supporting set 20, the rear frame 30 and the top board 50 by hand without any tools, which simplifies the assembly steps and allows single person operation. The direct placement of the bottom board 40 and the sliding placement of the divider 39 are paired with the top board 50, which effectively saves assembly time and reducing the number of parts.

Figure 10:
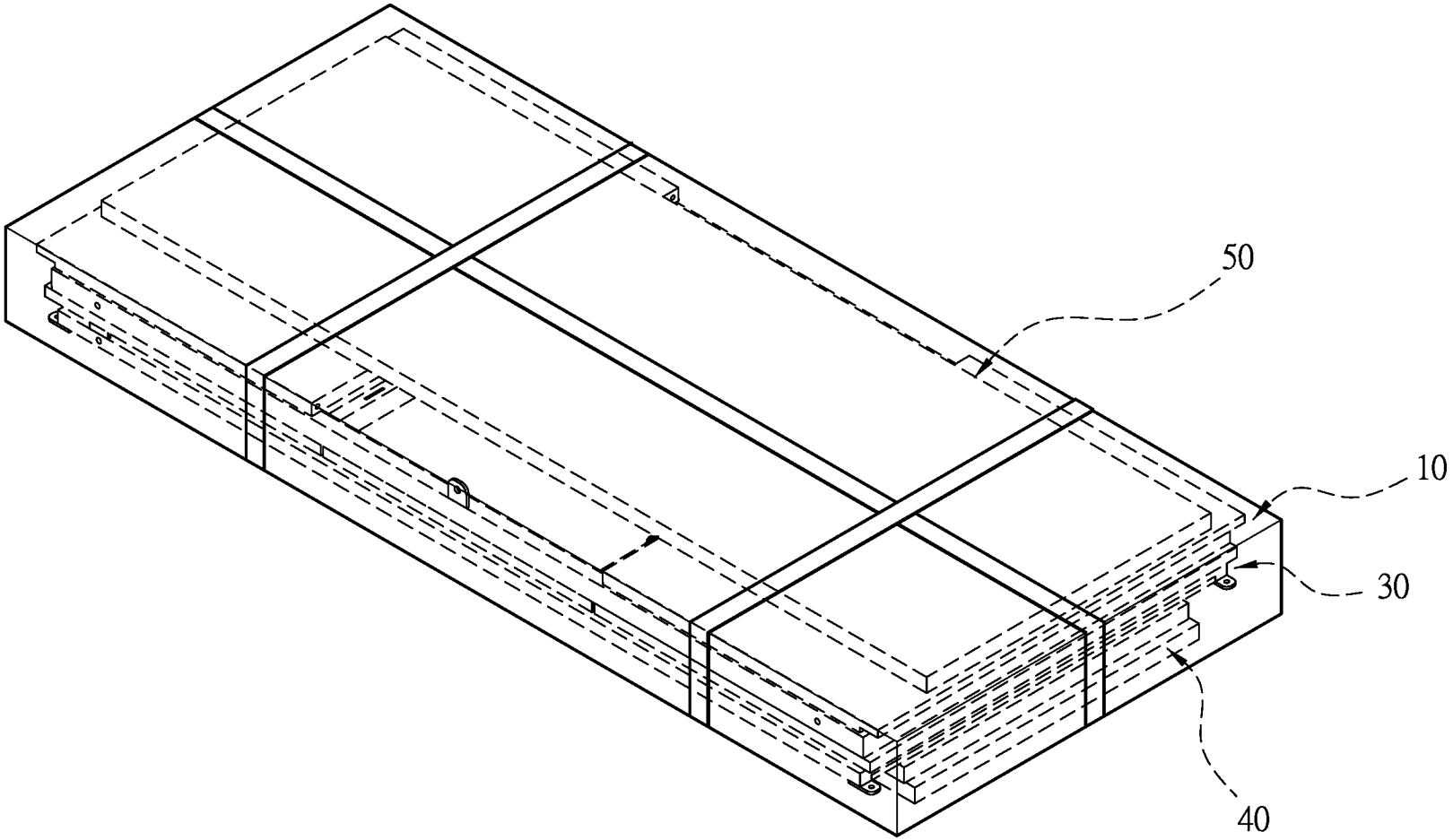
FIG. 10 is a perspective view of the present invention in a packaged state.

Another major effect of the present invention, as shown in FIGS. 9, 10, the front side rod 13 and the side board 14 are pivoted by the door hinge 15, the side board 14 is provided with a recess 141 corresponding to the door shaft set 131, and the side board 14 can be swung by the door hinge 15 parallel or perpendicular to the front frame 10. Furthermore, when the side board 14 is parallel to the front frame 10, the recess 141 accommodates the door shaft set 131, thereby reducing the volume of the front frame 10 by folding and overlapping the front frame 10, the supporting set 20, the rear frame 30, the divider 39, the storing board 18, the bottom board 40, and the top board 50 together, which can achieve both minimum volume packaging and rapid assembly.

Although the present invention has been explained in relation to its preferred embodiment, it is to be understood that many other possible modifications and variations can be made without departing from the spirit and scope of invention as hereinafter claimed.

What is claimed is:

1. A storage cabinet structure comprising:

a front frame having a front top rod, a front bottom rod and two front side rods, the front top rod having a plurality of through apertures, the front bottom rod having a plurality of screw holes, each said front side rod pivoted with a side board;

a supporting set having a plurality of leg members and at least one horizontal rod, opposite ends of each said leg member and each said horizontal rod having at least one through hole, each said through hole provided with a first bolt configured to engage with the screw holes of the front bottom rod;

a rear frame having a rectangular shape with a rear top rod, a rear bottom rod and two rear side rods, the rear top rod having a plurality of through apertures, the rear bottom rod having a plurality of screw holes configured to engage with the first bolts, each said rear side rod having a plurality of connecting plates, each said connecting plate having a second bolt, one end of each said side board capable of being locked onto the connecting plates of the rear side rods via the second bolts;

a bottom board disposed among the front frame, the side board and the rear frame, the bottom board mounted onto the supporting set, and a top board having a plurality of securing apertures on edges thereof, each said securing aperture provided with a plug, the top board covering the front top rod and the rear top rod, the plugs inserted into the through apertures of both the front top rod and the rear top rod.

2. The storage cabinet structure as claimed in claim 1, wherein the front frame further comprises at least one front standing rod between the front top rod and the front bottom rod, and a plurality of door hinges are disposed on the at least one front standing rod and the front side rods and configured to attach to at least one door member.

3. The storage cabinet structure as claimed in claim 2, wherein the rear frame further comprises at least one rear standing rod disposed between the rear top rod and the rear bottom rod, and the rear frame and the at least one rear standing rod are covered and secured with a rear board.

4. The storage cabinet structure as claimed in claim 3, wherein each of the at least one front standing rod and the at least one rear standing rod have at least one engaging groove, and each said engaging groove is mounted with a positioning sheet, a divider is connected between the at least one front standing rod and the at least one rear standing rod, the divider further having a slot facing each of the at least one front standing rod and the at least one rear standing rod and engaging with the positioning sheets of the at least one front standing rod and the at least one rear standing rod.

5. The storage cabinet structure as claimed in claim 4, wherein a plurality of assembling apertures are disposed on the side boards and the divider, and a supporting member is inserted in each said assembling aperture, and each said supporting member horizontally disposed between the side boards and the divider, the supporting members configured to support at least one storing board.

6. The storage cabinet structure as claimed in claim 5, wherein each said supporting member has a side part and a bottom part, the side part has a protrusion inserted into one said assembling aperture such that the side part overlaps one said side board or the divider, and the bottom part is jacketed with an elastic sleeve for supporting the at least one storing board.

7. The storage cabinet structure as claimed in claim 6, wherein a door hinge set is installed for a pivoting connection between the front side rods and the side boards, and each said side board further has an indentation corresponding to the door hinge set.

8. The storage cabinet structure as claimed in claim 1, wherein the front top rod and the rear top rod both have a plurality of connecting tabs, each said connecting tab has a third bolt, and each said third bolt is locked with the top board.

9. The storage cabinet structure as claimed in claim 8, wherein the first bolts, the second bolts, and the third bolts all respectively have a flat head portion and an opposite end having a threaded section.

* * * * *